United States Patent [19]

Barrow

[11] Patent Number: 5,003,844

[45] Date of Patent: Apr. 2, 1991

[54] PORTABLE CONTAINER OPENER

[76] Inventor: Bennie W. Barrow, 105C Northway Dr., Clarksville, Tenn. 37042

[21] Appl. No.: 478,448

[22] Filed: Feb. 12, 1990

[51] Int. Cl.[5] ..... B67B 7/18

[52] U.S. Cl. ..... 81/3.2; 81/3.33; 81/3.29; 81/3.43

[58] Field of Search ..... 81/3.2, 3.25, 3.31, 81/3.33, 3.36, 3.37, 3.29, 3.43, 3.4

[56] References Cited

U.S. PATENT DOCUMENTS

| | | | |
|---|---|---|---|
| 988,780 | 4/1911 | Horwath | 81/3.43 |
| 991,047 | 5/1911 | Cole | 81/3.36 |
| 1,702,261 | 2/1929 | Johnson | 81/3.2 |
| 2,026,118 | 12/1935 | Barnby | 81/3.2 |
| 2,389,301 | 11/1945 | Escher | 81/3.43 |
| 2,447,770 | 8/1948 | Ratchford | 81/3.36 |
| 2,559,358 | 7/1951 | Hullhorst | 81/3.2 |
| 3,084,573 | 4/1963 | Lipski | 81/3.43 |
| 3,812,742 | 5/1974 | Polasek | 81/3.33 |
| 4,171,650 | 10/1979 | Cardinal | 81/3.2 |
| 4,585,078 | 4/1986 | Alexandrov | 81/464 |
| 4,762,029 | 8/1988 | Chen | 81/3.2 |

FOREIGN PATENT DOCUMENTS

| | | | |
|---|---|---|---|
| 914693 | 1/1963 | United Kingdom | 81/3.2 |

*Primary Examiner*—Roscoe V. Parker

*Attorney, Agent, or Firm*—John C. Garvin, Jr.; James E. Staudt

[57] ABSTRACT

Disclosed is a portable opener for removal of covers which are threadedly attached to containers, such as jars of the type commonly found in households. The opener includes a unitary housing, shaped generally as an inverted L. The vertical portion of the housing contains a motor, and a power supply, while the upper, horizontal portion of the housing contains a drive mechanism which is driveably attached to the motor and to a vertically adjustable and removable first gripping means, which is adapted to grip the cover of a container. This first gripping means includes a resilient body which is adapted to be compressed around the container cover by an over center clamping mechanism. A second gripping means is provided to retain the container. The second gripping means surrounds the container and also utilizes an over center clamping mechanism. The second gripping mechanism is attached to the vertical portion of the housing by a pivot block which is adjustable in a vertical as well as a horizontal direction relative to the housing. The vertical adjustment in the pivot block and in the first gripping means permits the container to move downwardly as the cover is loosened, while the horizontal adjustment permits the opener to accommodate containers of different sizes. Both gripping mechanisms may easily be replaced to accommodate covers and containers of greatly varying sizes.

14 Claims, 2 Drawing Sheets

PORTABLE CONTAINER OPENER

BACKGROUND OF THE INVENTION

Covers used on threaded containers are normally securely tightened and are often difficult to remove. This is a particularly perplexing problem for the elderly or for persons lacking normal strength in their hands.

Many devices have been devised to assist in the opening of containers having threaded covers. The prior art in the field includes a myriad of manual devices which provide the user with mechanical leverage type of assistance, as well as power driven openers the use of which are intended to require minimum strength or dexterity.

Each of the following listed United States Patents illustrate manual opening devices. These patents disclose a variety of means for gripping containers and their covers, and are therefore considered pertinent: Look U.S. Pat. No. 635,049; Harwath U.S. Pat. No. 988,780; Escher U.S. Pat. No. 2,389,301; and Lipski U.S. Pat. No. 3,084,573. Power driven openers are disclosed in Patents to Cardinal U.S. Pat. No. 4,171,650 and to Chen U.S. Pat. No. 4,762,029. Review of the prior art power openers shows them to be complex, cumbersome and quite difficult to operate. In each device the container is retained by a gear driven mechanism which must be adjusted to accommodate containers of varying heights. It is also apparent that the means utilized to grip both the container and its cover are neither positive nor versatile. For example, note that the device of Cardinal requires a near perfect fit between its cover gripper and the cover. Note also that the cover and container gripping devices of Chen make only point contacts with the container and the container cover. Further, the container gripping means of Cardinal and Chen depend upon a vertical force which applies an equal force to the threaded areas of the container and the cover. This force actually adds to the rotational effort required to rotate the cover relative to the container.

It is therefore an object of my invention to provide a power driven, light weight, portable opening device for the loosening or tightening of covers of containers having various sizes and shapes, which device overcomes the above mentioned and other prior art deficiencies, and which is easily operable by persons having limited dexterity and strength in their hands.

SUMMARY OF THE INVENTION

A portable device for removal or replacement of covers which are designed for threaded attachment to containers, such as common jars which are used in the home. The device includes a unitary housing shaped generally as an inverted L. The vertical portion of the housing contains an adjustable container gripper, a motor and a power supply. The upper, horizontal portion of the housing contains a drive mechanism which is driveably attached to the motor and to a gripping assembly which is adapted to grip the cover of a container. The gripping assembly includes a resilient body portion which is adapted to be compressed tightly around the container cover and in practice is compressed by an open ended clamp which is attached to and surrounds the body of the gripper assembly. The clamp is provided with an overcenter connector which is adapted to reduce the diameter of the clamp so as to tighten the resilient body around the cover. A similar type clamp is attached to the vertical portion of the housing and is adapted to firmly attach a container to the housing. The device is provided with a carrying handle which houses a three way switch which is adapted to control the motor to run in a clockwise or counterclockwise direction or to stop when the loosening of tightening operation is complete.

DESCRIPTION OF THE PREFERRED EMBODIMENT

Figure 4:
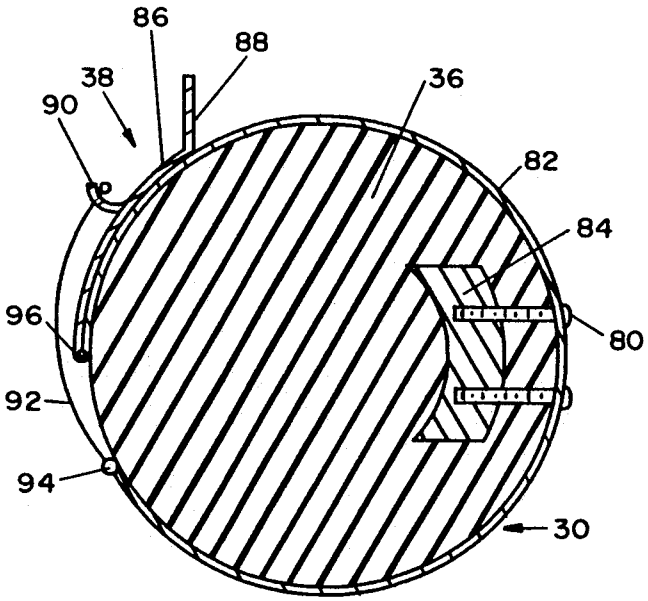
FIG. 4 is a sectional view taken on line 4—4 of FIG. 1.
Figure 1:
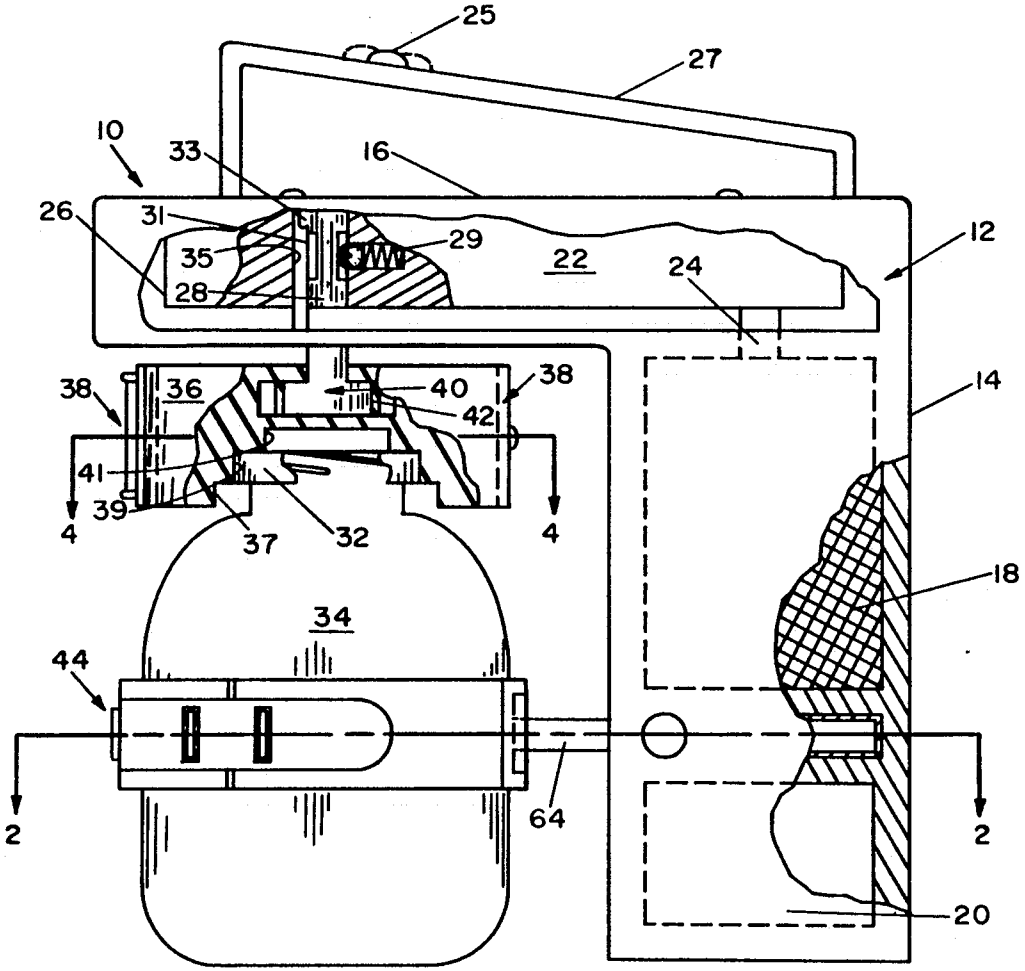
FIG. 1 is a side elevational view of a device for loosening or tightening covers which are adapted to be threadedly attached to containers.

The present invention is a device primarily for loosening threaded covers from containers, however it may be used to tighten the covers as well. For convenience in terminology the device which is indicated generally by reference numeral 10 will be referred to as a container opener.

The opener comprises a housing 12 having a vertical portion 14 and a horizontal portion 16 and is generally shaped as an inverted L. The housing encloses an electric motor 18, a battery type power supply 20 and a driving mechanism 22. The motor is driveably attached to the driving mechanism by a shaft 24. The motor 18 may be operated in either a clockwise or counterclockwise direction by actuation of a three position switch 25 which is mounted in a handle 27 which in turn is attached to horizontal housing portion 16. While a typical gear reduction drive mechanism may be utilized, the preferred drive mechanism includes a repetitive impact type loosening device. Such impact devices are well known and are easily adapted for use in the disclosed container opener. An example of such impact loosening devices is disclosed in U.S. Pat. No. 4,585,078 to Alexandrov. Use of an impact device enables a small electric motor to provide sufficient rotational force to loosen even the tightest container covers. The drive mechanism 22 is contained within a case 26. Rotational output from the drive mechanism is transmitted by a removable, driven shaft 28 to a first gripper assembly 30 which is adapted to receive and to grip a cover 32 which is threadedly attached to a container 34. The drive mechanism 22 is provided with a spring loaded ball retainer 29 which is adapted to engage a vertically extending recess 31 formed in the driven shaft 28. This spring ball connection system permits removal and replacement of the gripper assembly 30 by application of a vertical force in the desired direction. The vertically extending recess 31 permits the shaft 28 to move in a vertical direction so as to accommodate the vertical movement of the cover 32 relative to the container 34 during extended relative rotation therebetween. The shaft 28 includes a protrusion 33 which engages a slot 35 in the drive mechanism 22 to provide a driveing connection therebetween. The gripper assembly 30 includes a resilient body portion 36 and a clamping apparatus 38. The resilient body 36 is attached to a flange 40 located at the bottom end of the driven shaft 28. Attachment of the body 36 to the flange 40 is achieved by molding the body 36 to the flange 40. A series of vertical holes 42 are included in the flange 40 to strengthen the molded connection. In operation the resilient body 36 is compressed radially inwardly by the clamping apparatus 38 so as to tightly grip the cover 32 in a manner which will be explained in more detail later in this specification. The resilient body 36 is provided with a series of stepped gripping surfaces 37, 39, and 41 which decrease in diameter from the lower surface 37 upwardly. These surfaces provide a selection of gripping surfaces to accommodate container covers of different sizes. Because of the resiliency of the body 36 and the clamping action which is utilized, it is not required that the container cover fit tightly into the gripping surfaces prior to the clamping operation. It will thus be appreciated that even nonstandard sized container covers can be firmly gripped. Accommodation of container covers of sizes considerably larger or smaller than those included in a given gripper apparatus is accomplished by replacement of the entire gripper apparatus with one of the correct size. This is quickly and easily accomplished by removal of the shaft 28 from the driving mechanism 22 in the manner described above.

Figure 3:
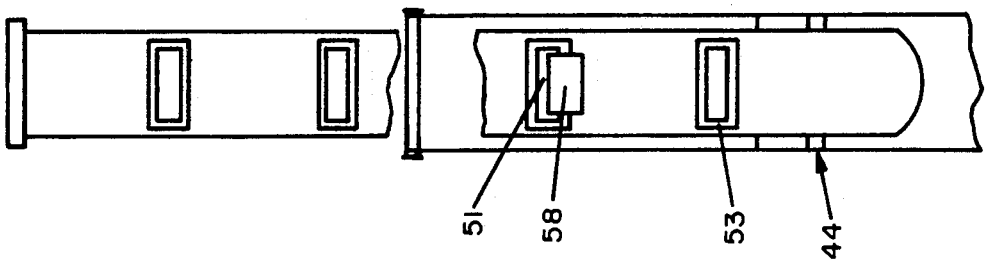
FIG. 3 is a fragmented elevational view showing details of the strap portion of the clamping means illustrated in FIG. 2.
Figure 2:
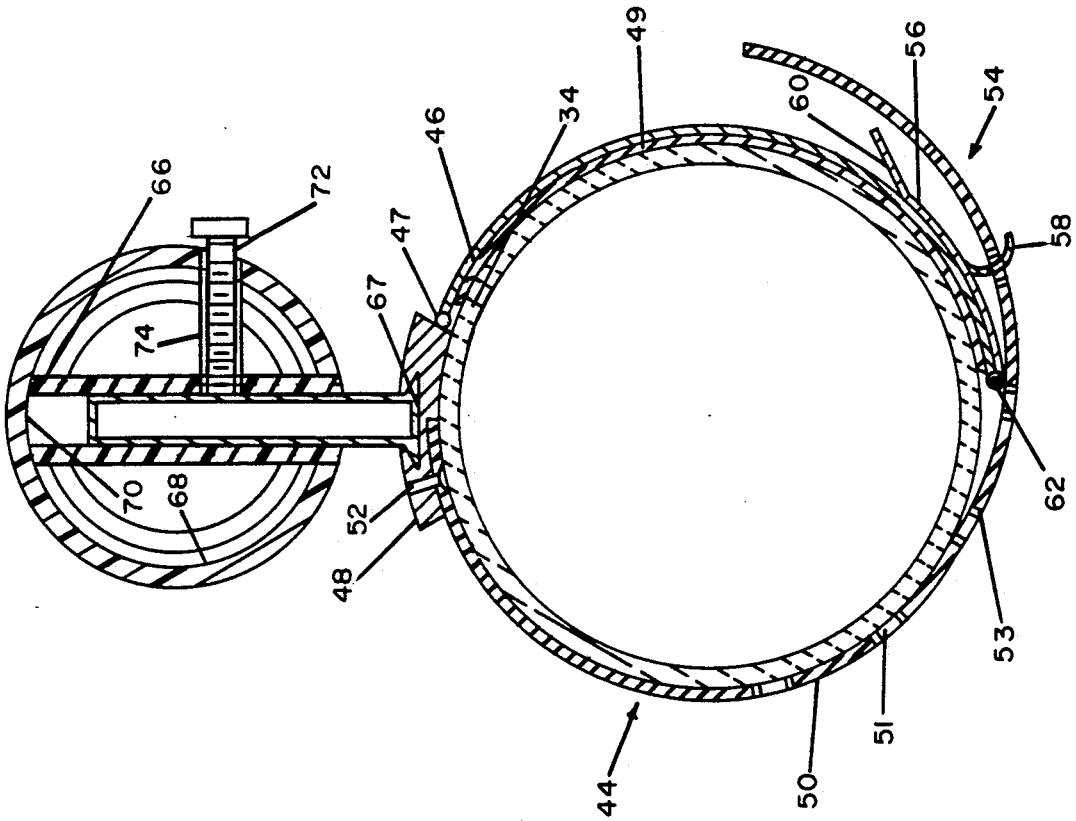
FIG. 2 is an enlarged sectional view taken on line 2—2 of FIG. 1 illustrating a clamping means which facilitates the attachment of the device to a container.

The container 34 is firmly and removably held to the vertical portion 14 of housing 12 by a second gripping assembly 44, the details of which are best illustrated in FIGS. 2 and 3.

Referring now to FIG. 2, the second gripper assembly 44 is comprised of a flexible strap 46 which may be formed of spring steel or a high strength plastic. The strap 46 is provided with a resilient lining 49 which is formed of a material such a rubber which serves to tightly grip the container 34 without causing it damage. The strap 46 is removeably and pivotally attached to a pivot block 48 by a pin type pivot connection 47. A resilient, stretchable strap 50 having receptor holes 51 is attached to the other side of pivot block 48 by screws 52 which pass through the strap 50 and threadedly engage pivot block 48. Thus the straps 46 and 50 may be easily changed for utilization of straps of varying width, length or in the case of strap 50, curvature. The strap 50 may be formed of rubber or a similar suitable material and is adapted to be stretched around container 34 so as to hold the container in place during operation of the opener. The receptor holes 51 of strap 50 are lined with rigid collars 53. In operation the strap 50 is pulled snugly around container 34 by an over center clamping mechanism 54 which includes a lever 56 having a hook 58 and a lifting tab 60. The lever 56 is pivotally attached at 62 to one end of the strap 46. In operation the clamp mechanism 54 serves to stretch the strap 50 firmly around the container 34.

The pivot block 48 is slideably attached to a rectangular bar 64 by means of a dovetail portion 65 which fits snugly into a dovetail slot 67. This arrangement permits the second gripping apparatus 44 to move vertically to accommodate the vertical movement of the container 34 caused by the loosening or tightening of the container cover during operation of the device. The rectangular bar 64 is slideably inserted into a likewise rectangular receiver tube 66. The tube 66 passes through and is attached to a cylindrical wall 68 of the vertical housing portion 14, passes through the housing portion 14 and is attached to a wall 70 of the housing portion 14. In operation the bar 64 is adjusted inwardly and outwardly to accommodate containers of various diameters. The bar is locked in place after adjustment by means of a locking screw 72 which passes through the walls of housing portion 14 and receiver tube 66 so as to abut slide bar 64. The locking screw 72 is attached to the wall of housing portion 14 by means of a threaded boss 74 which is attached to vertical housing portion 14 by suitable means such as welding.

Referring now to FIG. 4, the details of the first gripper assembly 30 are shown. The gripper assembly consists of the resilient body 36 which is encircled by the clamping apparatus 38 which is attached to resilient body 36 by means of screws 80 which pass through a flexible metal strap 82 and a protion of the body 36, and are threaded into an imbedded screw block 84. The clamping apparatus 38 consists of an actuating lever 86 having a lift tab 88 on one end thereof, a hook 90 in the midportion thereof and is pivotally attached at the distal end thereof to one end 96 of the strap 82. A tension spring connector 92 is utilized to connect the hook portion of lever 86 to one end of strap 82. The tension spring connector 92 forms a loop, one end of which is pivotally connected at 94 to one end of the strap 82. As illustrated in FIG. 4 the spring has an arcuate configuration in the vertical plane. This configuration provides a spring action which firmly tightens the strap 82 around the resilient body 36 when the clamping apparatus 38 is in the closed position.

Figure 5:
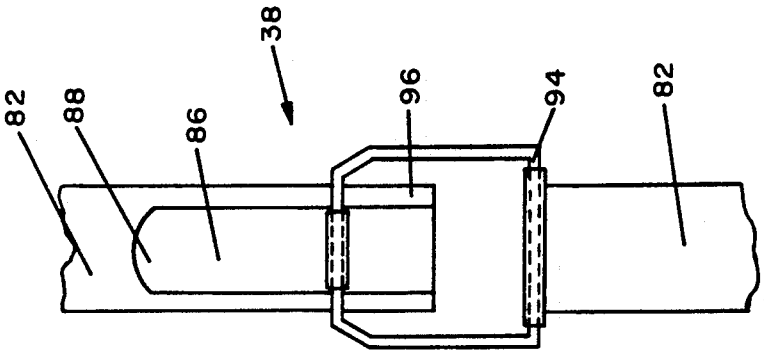
FIG. 5 is a fragmented elevational view showing details of the over center clamp connector illustrated in FIG. 4.

The configuration of the clamping apparatus 38 is more clearly illustrated in the frontal view of FIG. 5.

In operation the cover 32 of the container 34 is placed in the appropriately sized step 37, 39, or 41 of the first gripper assembly 30 and is firmly gripped therein by actuation of the clamping apparatus 38. As best illustrated in FIG. 4 and as described briefly above, rotation of lever 86 from an open position to the closed position reduces the circumference of the circle generally defined by the strap 82. In this way the resilient body 36 is squeezed radially inwardly causing a radially inward movement of the steps 37, 39, and 41. As will be readily understood the radially inward movement of the steps serves to tightly grip a container cover in its appropriate step. As previously noted the entire first gripper assembly may be changed to accommodate different sized container covers by application of a downward force which releases the shaft 28 from the drive mechanism 22. The second gripper assembly 44 is adjusted to contact the container by lateral movement of the slide bar 64 within the receiver tube 66 as is best illustrated in FIG. 2. After adjustment, the slide bar 64 is clamped firmly in place by tightening the locking screw 72. The container 34 is then gripped by actuation of the clamping mechanism 54. The clamping mechanism 54 functions in the same general manner as the clamping apparatus 38 described above. However important differences between the first and second gripping assemblies provide features to adapt each to its specific use. The first gripper assembly 30 utilizes a strap 82 which is fabricated of spring steel or a like material which is bendable but which will stretch little if any when placed in tension. This assembly is thus capable of placing extreme pressures on the container covers which are quite strong but offer a relatively small gripping surface. Conversely, the second gripping assembly is provided with a strap 50 which is formed of a rubber or similar material which provides a firm but yieldable gripping surface. Thus it is readily understood that this gripping assembly is well suited for use in gripping fragile containers such as house hold jars. It will also be appreciated that the gripping area of the straps 46 and 50 may be easily changed to accommodate varying gripping requirements by removal and replacement of the desired strap with one having greater or lessor width so as to increase or decrease the gripping area which comes in contact with the container. The strap 50 may be replaced by removal of the retainer screws 52 while the strap 46 may be replaced by removal of a pin from the pivotal connector 47. Having appropriately clamped the container 34 and its cover 32 firmly in place the opening or tightening operation is accomplished by actuation of the three position switch 25 to the desired position. As previously mentioned rotation of the container 34 relative to the cover 32 causes a vertical movement of the container which is permitted by the vertical slide connection between the bar 64 and the pivot block 48 as well as by the vertically moveable shaft 28. It is readily understood that the vertical position of the shaft 28 and the pivot block 48 will be adjusted as desired before operation of the opener so as to accommodate the intended relative vertical displacement between the cover 32 and the container 34 during either a loosening or a tightening operation. It is apparent that the opener could function to rotate the cover 32 a small amount relative to the container 34 without benefit of vertically moveable elements such as the shaft 28 and the pivot block 48. However, extended relative vertical movement between the cover 32 and the container 34 require this feature.

It is to be understood that the present invention is not limited to the particular embodiments shown and described hereinabove and that numerous other variations may be made in the container opener without departing from the spirit and scope of the invention a defined in the claims below.

I claim:

1. A portable device for removing a threaded cover from a container consisting of a housing having a carrying handle, a vertical portion and a horizontal portion; an electric motor mounted adjacent said horizontal portion in the vertical portion of said housing, said motor having a drive shaft which extends upwardly into said horizontal portion; a power supply adapted to drive said motor; a switch adapted for selective actuation of said motor; a drive mechanism mounted in said horizontal portion of said housing and driveably attached to said shaft of said motor; a driven shaft attached to said drive mechanism for rotation thereby, said shaft being laterally spaced from said vertical portion of said housing and extending downwardly from said horizontal portion of said housing; a first gripping means attached to said driven shaft, said first gripping means being adapted to grip said threaded cover; and a second gripping means attached to the vertical portion of said housing, said second gripping means being adapted to grip said container, whereby upon actuation of said motor by operation of said switch said threaded cover will be rotated relative to said container.

2. A device as set forth in claim 1 wherein said first gripping means comprises a resilient body adapted to surround the circumference of said cover, and means for deforming said resilient body radially inwardly so as to firmly grip said threaded cover.

3. A device as set forth in claim 2 wherein said second gripping means is adapted to extend around the circumference of said container and wherein said second gripping means is attached to said vertical portion of said housing by lateral adjusting means, whereby the lateral distance between said second gripping means and said vertical portion of said housing may be adjusted.

4. A device as set forth in claim 3 wherein said second gripping means comprises a flexible semi ring adapted to conform to the configuration of said container, said semiring being attached at one end by connecting means to said vertical portion of said housing and having a clamping mechanism attached to the other end thereof; and an elastic strap being attached at one end to said vertical portion of said housing by said connecting means, said strap being adapted at the distal end thereof to engage said clamping mechanism so as to firmly retain said container within said gripping means.

5. A device for removing a threaded cover from a container comprising a housing having a vertical portion and a horizontal portion; an electric motor mounted in the vertical portion of said housing; a power supply adapted to drive said motor; a switch adapted for selective actuation of said motor; a drive mechanism mounted in said horizontal portion of said housing and driveably attached to said motor; a driven shaft attached to said drive mechanism for rotation thereby, said shaft being laterally spaced from said vertical portion of said housing and extending downwardly from said horizontal portion of said housing; a first gripping means attached to said driven shaft, said first gripping means comprises a resilient body adapted to surround the circumference of said cover, and means for deforming said resilient body radially inwardly so as to firmly grip said threaded cover; and a second gripping means attached to the vertical portion of said housing by lateral adjusting means, whereby the lateral distance between said second gripping means and said vertical portion of said housing may be adjusted, said second gripping means being adapted to extend around the circumference of said container to grip said container, whereby upon actuation of said motor by operation of said switch said threaded cover will be rotated relative to said container; said drive mechanism includes a repetitive impact means for increasing the rotational loosening capability of said electric motor.

6. A device as set forth in claim 5 wherein said drive mechanism is contained within an enclosed case.

7. A device as set forth in claim 3 wherein each of said first and second gripping means is tightened into its gripping position by an over center lever actuated clamping means.

8. A device as set forth in claim 6 wherein said connecting means comprise a pivot block attached to said vertical portion of said housing, and wherein said pivot block is attached to said vertical portion of said housing by a vertically adjustable slide means whereby said pivot block may be adjustable in a vertical direction relative to said vertical portion of said housing so as to accommodate vertical movement between said cover and said container during extended relative rotation therebetween.

9. A device as set forth in claim 8 including a resilient lining attached to the radially inner surface of said semiring so as to form a gripping surface between said semiring and said container.

10. A device as set forth in claim 9 wherein said driven shaft is provided with a vertically extending detent and wherein said drive mechanism is provided with a spring loaded ball adapted to engage said vertically extending detent in said shaft whereby said shaft is removeably attached to said drive mechanism and whereby said shaft is movable in a vertical direction within said drive mechanism so as to accommodate vertical movement between said cover and said container during extended relative rotation therebetween.

11. A device as set forth in claim 10 including a handle attached to the horizontal portion of said housing.

12. A device as set forth in claim 11 wherein said switch is mounted in said handle.

13. A device as set forth in claim 12 wherein said switch is a three position switch which is adapted to selectively actuate said motor in a clockwise as well as a counter clockwise direction during operation of said opener.

14. A device as set forth in claim 13 wherein said power supply is contained within said housing.

* * * * *